United States Patent [19]

Whiteman et al.

[11] Patent Number: 4,505,832

[45] Date of Patent: Mar. 19, 1985

[54] ANTI-FRETTING ADDITIVE FOR GREASE COMPRISING THE REACTION PRODUCT OF AN ALKENYL SUCCINIC ANHYDRIDE AND AN ALKANOLAMINE

[75] Inventors: James R. Whiteman, Port Arthur; Robert S. Edwards, Nederland, both of Tex.; Jerry C. Perciful, Danbury, Conn.

[73] Assignee: Texaco Inc., White Plains, N.Y.

[21] Appl. No.: 529,445

[22] Filed: Sep. 6, 1983

[51] Int. Cl.[3] ..... C10M 5/12; C10M 5/14; C10M 5/20

[52] U.S. Cl. ..... 252/42.1; 252/51.5 A

[58] Field of Search ..... 252/42.1, 51.5 A

[56] References Cited

U.S. PATENT DOCUMENTS

| | | | |
|---|---|---|---|
| 3,431,204 | 3/1969 | Giammaria | 252/51.5 A |
| 3,446,737 | 5/1969 | Panzer et al. | 252/42.1 |
| 3,879,306 | 4/1975 | Kablaoui et al. | 252/51.5 A |
| 4,104,177 | 8/1978 | Caruso | 252/51.5 A |

*Primary Examiner*—W. J. Shine

*Attorney, Agent, or Firm*—Robert A. Kulason; James J. O'Loughlin; Richard A. Morgan

[57] ABSTRACT

Provided are polyurea and lithium complex grease compositions whose anti-fretting properties are improved by the addition of an anti-fretting additive which comprises the reaction product of an alkenyl succinic acid or anhydride having the structural unit represented by the following formula:

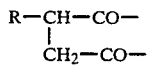

in which R is an alkenyl of 10 to 35 carbon atoms, and an alkanolamine which is represented by the following formula:

$$H_2N(CH_2)_nOH$$

in which n is an integer from 2 to 6.

12 Claims, No Drawings

ANTI-FRETTING ADDITIVE FOR GREASE COMPRISING THE REACTION PRODUCT OF AN ALKENYL SUCCINIC ANHYDRIDE AND AN ALKANOLAMINE

BACKGROUND OF THE INVENTION

Fretting, which is one of the most serious problems that engineers have to deal with in the designing and building of new machines or apparatus, is a particular type of corrosion found on the contact areas of loaded metal surfaces subject to oscillatory or vibratory motion. The problem of fretting occurs not only in the moving parts of an apparatus, but also in the stationary parts therein. Examples of such non-moving parts in which fretting has been observed include shrink fits, press fits, bolted flanges and keyed gears. Examples of such moving parts in which fretting has been observed include bearings undergoing an oscillatory motion, flexible couplings, and reciprocating cams.

Two or more surfaces when rubbed together generate therein a reciprocating motion which, as current belief holds, causes mechanical wear and, consequently, fretting. This reciprocating motion, which is linear, oscillatory or vibratory in nature, is of limited amplitude, producing no more than just a relative slip between the surfaces.

Between contacting metal surfaces, plastic deformation, that is, the interlocking on a microscopic scale of the contacting high points, is thought to cause fretting. A tangential force exerted on the surface does not separate the contacting high points along their original interface. Instead, a small piece of metal which becomes lodged between the contacting metal surfaces is sheared off from the points of contact. Acting as an abrasive, the loose metal particles soon start to wear down the contacting metal.

Once started, fretting corrosion is difficult to stop for the formation of one wear particle inevitably leads to the production of others. Fretting damage can lead to fatigue failures, galling, jamming of critical clearances with abrasive debris, and other undesirable effects. Often times, the damage done by fretting is serious enough to completely immobilize the moving part, or to wear down or corrode a non-moving part.

Of special concern to design engineers is the damage done by fretting corrosion, a type of fretting which occurs between contacting metal (steel, iron, etc.) parts. Oxygen reacts with the metal surfaces, or with the wear particles therefrom, and the corrosion caused by the formed rust can spread and immobilize the entire apparatus.

One solution to the fretting problem is to separate and keep apart contacting surfaces with a lubricant such as a grease composition. To perform satisfactorily, this grease must inhibit fretting corrosion and must also be able to perform at high temperatures.

Greases employed heretofore have generally been found to be unsatisfactory in both preventing fretting or fretting corrosion and in working in a high temperature environment. A new grease composition has been discovered which substantially mitigates or overcomes the fretting and fretting corrosion problems noted above.

It is the object of the instant invention to provide a novel grease composition characterized by having substantial anti-fretting and anti-fretting corrosion properties.

It is another object of the invention to provide an anti-fretting grease composition which is effective in a high temperature environment.

DISCLOSURE STATEMENT

Coassigned, U.S. Pat. No. 3,879,306 discloses as an additive for automatic transmission fluids a succinamic acid or a succinamic acid—succinimide mixture represented by the following formula:

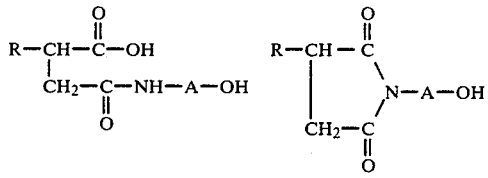

amic imide in which R is an alkenyl group having from 10 to 30 carbon atoms and A is a divalent saturated aliphatic hydrocarbon radical having 1 to 6 carbon atoms. The finished automatic transmission fluid composition containing these additives demonstrates superiority with respect to resistance to friction modifier breakdown and/or shift quality.

Coassigned, U.S. Pat. No. 3,903,005 discloses as an additive for transmission, differential and hydraulic systems an N-(carboxylalkylene) hydrocarbyl succinimide represented by the formula:

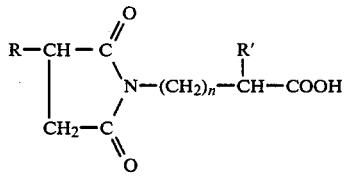

in which R is an alkenyl group having from 5 to 20 carbon atoms, R′ is hydrogen or alkyl group having from 1 to 10 carbon atoms and n is an integer from 0 to 5. The additive provides effective corrosion protection to transmission, differential and/or hydraulic fluids and does not adversely affect the other purposes to which the oil is employed.

Coassigned, U.S. Pat. No. 4,104,182 discloses as an additive for a lubricating oil composition a hydrocarbon-substituted succinimide represented by the formula:

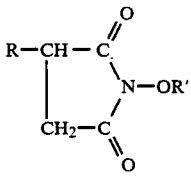

in which R is an aliphatic hydrocarbon radical having from about 1 to 50 carbon atoms and R′ is a hydrocarbon radical having from 3 to 20 carbon atoms. The additive is effective in softening the deposits that are formed in the combustion zone of an internal combustion engine when metal-containing additives, such as organic metal salts, are present in the lubricating oil.

Coassigned, U.S. Pat. No. 4,048,080 which is hereby incorporated by reference discloses as a dispersant additive for lubricating oil the reaction product of an alkenyl succinyl radical represented by the formula:

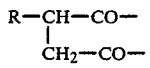

in which R is an alkenyl radical having an average molecular weight ranging from about 250 to 3000, and an amine which is represented by the formula: R'R" N-X-Y in which R' and R" represent hydrogen or a monovalent alkyl, aminoalkyl or hydroxyalkyl radicals having from 1 to 8 carbon atoms, X is a divalent hydrocarbon radical having from 2 to 8 carbon atoms and Y is selected from the group consisting of hydrogen and radical amino, hydroxy, and alkyleneoxide groups. An oil composition containing as the dispersant additive the amine-alkenyl succinic acid or anhydride reaction product exhibits effective protection against sludge and varnish formation.

Coassigned, U.S. application Ser. No. 362,329 discloses as a fuel economizing additive for engine crankcase lubricants several ashless rust inhibitors, one of which is represented by the formula:

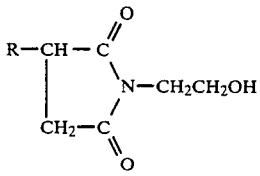

wherein R is an N-alkyl group having 12 to 20 carbon atoms or an N-monoalkanol group having 14 to 20 carbon atoms. This additive simultaneously imparts rust inhibiting and friction reducing properties to a crankcase engine lubricant.

SUMMARY OF THE INVENTION

This invention relates to an additive for improving the anti-fretting and high work temperature tolerance of polyurea and lithium complex grease which additive comprises the reaction product of an alkenyl succinic acid or anhydride having the structural unit represented by the formula:

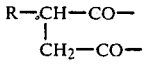

in which R is an alkenyl group having about 10 to 35 carbon atoms, and an alkanolamine which is represented by the formula:

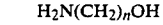

in which n is an integer from 2 to about 6.

Also encompassed within the scope of this invention are the polyurea and lithium complex greases containing said additive.

DETAILED DESCRIPTION OF THE INVENTION

The principal products of the prescribed reaction between an alkenyl succinic acid or anhydride and an alkanolamine that can be employed in the instant invention include N-(hydroxyalkyl) alkenyl succinamic acid, N-(hydroxyalkyl) alkenyl succinimide, and N,N'-di(hydroxyalkyl) alkenyl succinamide. These are represented by the following structural formulas:

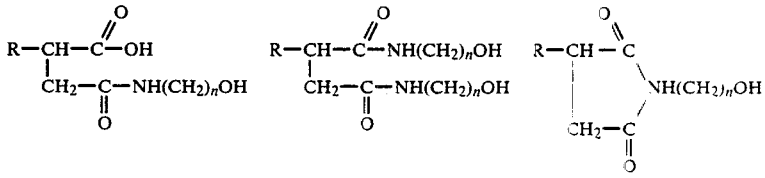

Amic Amide Imide wherein R is an alkenyl group having about 10 to 35 carbon atoms and n is an integer from 2 to about 6.

The amic acid is formed when the alkenyl succinic anhydride and alkanolamine are reacted at a temperature of 30° C. to 65° C. or above, preferably 40° C. to 50° C., utilizing a mole ratio of anhydride to alkanolamine of about 0.9:1 to less than about 1:1. Both the imide and the amide are formed at a temperature between 90° C. and 125° C. or above, preferably 100° C. to 115° C. The imide is preferentially formed when the mole ratio of anhydride to alkanolamine is from about 0.9:1 to less than about 1:1. The amide is preferentially formed when the mole ratio of anhydride to alkanolamine is greater than 1:1, preferably from 1:1 to 2:1 or above.

It is preferable in preparing all three reaction products (that is, the amide, imide and amic acid) to react the alkenyl succinic anhydride and alkanolamine in the presence of pale oil and to conduct the reaction in the presence of an inert gas, such as nitrogen.

The alkenyl succinic acid or anhydride structural unit employable in the instant invention is represented by the following formula:

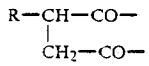

in which R is an alkenyl group having from 10 to 35 carbon atoms. Preferably R is an alkenyl group having 12 to 25 carbon atoms and more preferably an alkenyl group of 14 to 20 carbon atoms. Examples of suitable alkenyl groups include decenyl, dodecenyl, tetradecenyl, octadecenyl, and tricosenyl. For the purposes of this invention the alkenyl succinic acid and the alkenyl succinic anhydride function as reaction equivalents, that is, the same products are formed with either the acid or anhydride reactant.

The alkanolamine employable in the instant invention is represented by the following formula:

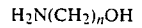

in which n is an integer from 2 to 6. Preferably n is an integer from 2 to 5 and more preferably an integer from 2 to 3. Examples of suitable alkanolamine reactants are monoethanolamine, 1,2-propanolamine, 1,3-propanolamine, 1,2-butanolamine, 1,3 butanolamine and 1,4-butanolamine.

Examples of succinamic acid products are
N-(2-hydroxyethyl)-n-tetradecenyl succinamic acid,
N-(3-hydroxypropyl)-n-tetradecenyl succinamic acid,
N-(2-hydroxypropyl)-n-tetradecenyl succinamic acid,
N-(4-hydroxybutyl)-n-dodecenyl succinamic acid,
N-(3-hydroxybutyl)-n-octadecenyl succinamic acid,
N-(2-hydroxybutyl)-n-dodecenyl succinamic acid,
N-(2-hydroxyethyl)-n-decenyl succinamic acid, and
N-(2-hydroxyethyl)-n-octadecenyl succinamic acid.

Examples of the succinimide products are
N-(2-hydroxyethyl)-n-tetradecenyl succinimide,
N-(2-hydroxypropyl)-n-tetradecenyl succinimide,
N-(3-hydroxypropyl)-n-tetradecenyl succinimide,
N-(4-hydroxybutyl)-n-dodecenyl succinimide,
N-(2-hydroxybutyl)-n-octadecenyl succinimide,
N-(2-hydroxyethyl)-n-octadecenyl succinimide, and
N-(2-hydroxyalkyl)-n-tricosenyl succinimide.

Examples of succinamide products are
N,N'-di(2-hydroxyethyl)-n-tetradecenyl succinamide,
N,N'-di(2-hydroxypropyl)-n-tetradecenyl succinamide,
N,N'-di(2-hydroxypropyl)-n-tetradecenyl succinamide,
N,N'-di(3-hydroxypropyl)-n-tetradecenyl succinamide,
N,N'-di(4-hydroxybutyl)-n-dodecenyl succinamide, and
N,N'-di(2-hydroxybutyl)-n-octadecenyl succinamide.

The alkenyl succinic acid (anhydride) and alkanolamine reaction product of the invention can be added to polyurea thickened grease or to lithium complex soap thickened grease in an amount of from 1 to 10 weight percent and preferably from 1 to 5 weight percent. The preferred additive is the succinimide form of the alkenyl succinic acid (anhydride) and alkanolamine reaction product.

The base oil forming the major component of the grease composition may be any oil having lubricating characteristics. Any conventionally refined base stocks derived from paraffinic, naphthenic and mixed mineral oil base crudes can be employed. In general, the naphthenic or paraffinic base oils or their blends will have Saybolt Universal viscosities in the range of from about 35 seconds to 300 seconds at 210° F. When a lubricating oil blend is employed in the grease making process, the oils may be blended as they are being used or they may be blended separately beforehand. The preferred mineral base oils are those having Saybolt Universal viscosities in the range of from about 67 seconds to about 87 seconds at 210° F.; they may be blends of lighter or heavier oils in the lubricating oil viscosity range.

A polyurea grease composition will comprise from about 10 to 20% by weight, preferably 12 to 15% by weight, of a polyurea thickener comprising the reaction product of diphenylmethane diisocyanate, an aliphatic monoamine having from 8 to 20 carbon atoms and a short chain diamine having from 2 to 10 carbon atoms. Preferred as the monoamine is octadecyl amine and as the diamine, ethylene diamine. The aliphatic monoamine, short chain diamine and diisocyanate are present in a weight ratio of approximately 9:1:8, respectively.

A lithium complex grease composition will comprise from about 5 to 20% by weight, preferably from 10 to 15% by weight, of a lithium complex soap comprising the reaction product of lithium hydroxide and a hydroxy fatty acid having from 12 to 24 carbons and a dicarboxylic acid having from 4 to 12 carbon atoms. Preferred as the hydroxy fatty acid is 12-hydroxystearic acid and as the dicarboxylic acid, azelaic acid. The hydroxy fatty acid and dicarboxylic acid are present in the mixture in a weight ratio of about 1.8:1 to 2.1:1, respectively, with the lithium hydroxide being added in sufficient amounts to completely saponify the acid mixture.

The Examples given below illustrate that when the prescribed alkenyl succinic acid (anhydride) and alkanolamine reaction product are added to a polyurea and lithium complex grease their performance in terms of anti-fretting properties and ability to function in a high temperature environment is enhanced.

EXAMPLE I

Polyurea Grease

Polyurea grease containing the prescribed alkenyl succinic acid (anhydride) and alkanolamine reaction product was tested in the Fafnir Oxidation Test to determine whether the grease is effective in preventing fretting corrosion and in the High Temperature Bearing Performance Test to determine whether the grease can perform for a suitable length of time in a high temperature environment.

In the Fafnir Friction Oxidation Test (ASTM D4170), bearings containing a measured amount of grease thereon are caused to rotate. In an environment maintained at 212° F., the rotating bearings contact each other and the stationary support material of the test apparatus. After 24 hours the rotation is stopped, and the amount of grease left on the bearings is determined and compared with the amount originally placed on the bearings. The less grease which is lost, the more protection the grease offers against fretting corrosion. The bearings are also checked for signs of scarring, pitting, etc.

In the High Temperature Bearing Performance Test, a grease is charged to a bearing, and the bearing is rotated at a set speed and at a temperature of 300° F. until the bearing freezes. The number of hours that the bearing is able to rotate before it freezes serves as an indication of how long the grease can function under high temperature conditions.

TABLE I

| Thickener | Polyurea[1] | | | | |
|---|---|---|---|---|---|
| Trial | 1 | 2 | 3 | 4 | 5 |
| Additives, wt % | | | | | |
| phenyl-alpha-naphthylamine | 1 | 1 | 0 | 0 | 0 |
| barium bis(dinonylnaphthalene sulfonate) | 2 | 2 | 0 | 0 | 0 |
| m-cocoylsarcosine | 0.5 | 0.5 | 0 | 0 | 0 |
| N—(2-hydroxyethyl)-n-tetradecenyl succinimide | 0 | 1 | 0 | 1 | 0 |
| N,N'—di(2-hydroxyethyl)-n-tetradecenyl succinamide | 0 | 0 | 0 | 0 | 1 |
| TESTS | | | | | |
| Fafnir Friction Oxidation Test, mg. | 18.8 | 0.55 | 14.5 | 0.3 | 0.2 |
| High Temperature Bearing | — | — | 1297 | — | 1713 |

TABLE I-continued

| Thickener | Polyurea[1] | | | | |
|---|---|---|---|---|---|
| Trial | 1 | 2 | 3 | 4 | 5 |
| Performance Test, hr. | | | | | |

[1]These polyurea greases comprising from 16 to 20 weight percent of a polyurea thickener are prepared in the following manner:
1. charge the base oil to the reactor;≠2. add in a 2:1 weight ratio octadecyl amine and ethylene diamine;
3. heat to 150 to 160° F.;
4. add diphenylmethane diisocyanate;
5. heat to 190 to 200° F. and allow sufficient time for the polyurea thickener to completely form;
6. heat to 325 to 335° F.;
7. allow to cool and while stirring add additives, including the alkenyl succinic acid (anhydride and alkanolamine reaction product; and
8. mill.

Both the succinimide and succinamide successfully increased the ability of the polyurea grease to inhibit fretting corrosion, that is, without any additives 14.5 milligrams of grease were lost and with the succinimide and succinamide only 0.3 and 0.2 milligrams of grease, respectively, were lost. Also, the succinamide increased the time that the polyurea grease was able to perform in a high temperature environment, that is, without the additive, the grease performed for only 1297 hours, and with the additive it performed for almost 500 more hours to 1713 hours.

EXAMPLE II

Lithium Complex Grease

Lithium complex grease containing the prescribed alkenyl succinic acid (anhydride) and alkanolamine reaction product was also tested in the Fafnir Friction Oxidation Test and in the High Temperature Bearing Performance Test.

TABLE I

| Thickener | Lithium Complex[1] | | | | |
|---|---|---|---|---|---|
| Trial | 1 | 2 | 3 | 4 | 5 |
| Additives, wt % | | | | | |
| trimethyldihydroquinoline | 2 | 2 | 2 | 0 | 0 |
| p,p'-dioctyldiphenylamine | 2 | 2 | 2 | 0 | 0 |
| barium bis(dinonyl-naphthalene sulfonate) | 2 | 2 | 2 | 0 | 0 |
| m-cocoylsarcosine | 0.5 | 0.5 | 0.5 | 0 | 0 |
| N—(2-hydroxyethyl)-n-tetradecenyl succinamic acid | 0 | 1 | 0 | 0 | 0 |
| N—(2-hydroxyethyl)-n-tetradecenyl succinimide | 0 | 0 | 1 | 0 | 1 |
| TESTS | | | | | |
| Fafnir Friction Oxidation Test, mg. | 0.35 | 0.25 | 0.35 | 15.0 | 3.5 |
| High Temperature Bearing Performance Test, hr. | 538 | 1104 | 753 | — | — |

[1]These lithium complex greases comprising from 10 to 14 weight percent of a lithium complex thickener are prepared in the following manner:
1. charge the base oil to the reactor;
2. heat to 150 to 170° F.;
3. add in a 2:1 weight ratio 12-hydroxystearic acid and azelaic acid;
4. heat to 250° F. and hold at that temperature for one hour;
5. cool and add lithium hydroxide at a rate of 0.01 lb/min per lb. of fat;
6. heat to 410 to 420° F.;
7. cool and add both the remainder of oil (at 0.3 lb/min) and the desired additives, including the alkenyl succinic acid (anhydride) and alkanolamine reaction product;
8. mill.

As the data demonstrates, the succinamic and succinimide greatly increase the ability of the lithium complex grease to prevent friction corrosion, that is, without any additives, 15.0 milligrams of lithium complex grease were lost in the Fafnir Friction Oxidation Test and with the succinimide only 3.5 milligrams of grease were lost. And when the succinamic is added to a lithium complex grease composition containing a given set of additives, the amount of lithium grease lost was also reduced. Also, a formulated lithium complex grease was able to perform in the High Temperature Bearing Performance Test for a longer period of time, that is, an increase from 538 hours to 1104 hours and 753 hours with the addition of the succinamic acid and the succinimide, respectively.

It is unexpected and surprising that the product of the prescribed reaction between an alkenyl succinic acid (anhydride) and an alkanolamine, namely, N,N'-di(hydroxyalkyl) alkenyl succinamide, N-(hydroxyalkyl) alkenyl succinamic acid, and N-(hydroxyalkyl) alkenyl succinimide, dramatically increases the ability of both lithium complex thickened grease and polyurea thickened grease to prevent or inhibit fretting or fretting corrosion. It is also unexpected and surprising that this prescribed reaction product dramatically increases the time that both lithium complex thickened grease and polyurea thickened grease are able to function in a high temperature environment. With the addition of these prescribed additives, the polyurea grease compositions and the lithium complex grease compositions which were deficient heretofore performed in a superior manner both with regard to inhibiting fretting or fretting corrosion and with regard to functioning for an adequate length of time in a high temperature environment.

We claim:

1. An anti-fretting grease composition comprising a major amount of a lubricating oil having a thickener from the class consisting of 16 to 20 wt% polyurea soap and 10 to 14 wt% lithium soap and an effective anti-fretting amount of an additive selected from the group consisting of N,N'-di(2-hydroxyethyl)-n-tetradecenyl succinamide, N-(2-hydroxyethyl)-n-tetradecenyl succinamic acid and N-(2-hydroxyethyl)-n-tetradecenyl succinimide.

2. A grease composition as described in claim 1 wherein the anti-fretting additive is N,N'-di(2-hydroxyethyl)-n-tetradecenyl succinamide.

3. A grease composition as described in claim 1 wherein the anti-fretting additive is N-(2-hydroxyethyl)-n-tetradecenyl succinamic acid.

4. A grease composition as described in claim 1 wherein the anti-fretting additive is N-(2-hydroxyethyl)-n-tetradecenyl succinimide.

5. A grease composition as described in claim 1 wherein said additive is added in an amount ranging from about 1 to 10 weight percent.

6. A grease composition as described in claim 1 wherein said additive is added in an amount ranging from about 1 to 5 weight percent.

7. The grease composition of claim 1 wherein the thickener is a polyurea soap in the amount of 16 to 20 wt% and the additive is selected from the group consisting of N-(2-hydroxyethyl)-n-tetradecenyl succinimide and N,N'-di(2-hydroxyethyl)-n-tetradecenyl succinamide.

8. The grease composition of claim 7 wherein the additive is in an amount of about 1 wt%.

9. The grease composition of claim 7 wherein the additive is N-(2-hydroxyethyl)-n-tetradecenyl succinimide.

10. The grease composition of claim 1 wherein the thickener is a lithium soap in the amount of 10 to 14 wt% and the additive is selected from the group consisting of N-(2-hydroxyethyl)-n-tetradecenyl succinamic acid and N-(2-hydroxyethyl)-n-tetradecenyl succinimide.

11. The grease composition of claim 10 wherein the additive is in an amount of about 1 wt%.

12. The grease composition of claim 10 wherein the additive is N-(2-hydroxyethyl)-n-tetradecenyl succinimide.

* * * * *